US007296551B2

(12) United States Patent
Murata et al.

(10) Patent No.: US 7,296,551 B2
(45) Date of Patent: Nov. 20, 2007

(54) INTAKE MANIFOLD

(75) Inventors: Takamasa Murata, Shizuoka (JP); Chikara Shimomura, Shizuoka (JP)

(73) Assignee: Toyo Roki Seizo Kabushiki Kaisha, Shizuoka (JP)

( * ) Notice: Subject to any disclaimer, the term of this patent is extended or adjusted under 35 U.S.C. 154(b) by 62 days.

(21) Appl. No.: 11/372,029

(22) Filed: Mar. 10, 2006

(65) Prior Publication Data

US 2006/0201471 A1 Sep. 14, 2006

(30) Foreign Application Priority Data

Mar. 11, 2005 (JP) ..... 2005-070020

(51) Int. Cl.
*F02M 35/10* (2006.01)
*M29C 65/08* (2006.01)

(52) U.S. Cl. ..... 123/184.24; 123/184.34; 123/184.42; 123/184.47

(58) Field of Classification Search ..... 123/184.24, 123/184.34, 184.42, 184.47, 184.61
See application file for complete search history.

(56) References Cited

U.S. PATENT DOCUMENTS 4,210,107 A * 7/1980 Shaffer ..... 123/184.34
4,497,287 A * 2/1985 Schleiermacher et al. ..... 123/184.53
6,067,949 A * 5/2000 Hughes et al. ..... 123/184.34
6,216,656 B1 * 4/2001 Hada et al. ..... 123/184.34
6,234,132 B1 * 5/2001 Kopec et al. ..... 123/184.34
6,571,759 B2 * 6/2003 Homi ..... 123/184.47
2003/0019457 A1 * 1/2003 Ozeki ..... 123/184.34
2004/0149248 A1 * 8/2004 Koch et al. ..... 123/184.47

FOREIGN PATENT DOCUMENTS

JP 7-148769 6/1995

* cited by examiner

*Primary Examiner*—Marguerite McMahon
(74) *Attorney, Agent, or Firm*—Young & Thompson

(57) ABSTRACT

In an intake manifold in which air introduced from an introduction port is fed to each cylinder of an engine by use of multiple ducts which are disposed parallel, a communication space section which provides communication between the introduction port which introduces air and inlets of the ducts is provided, this communication space section is formed so as to extend in a direction in which the inlets of the ducts are arrayed, a funnel section which causes the inlets of the ducts to be arrayed on a same surface is formed in this communication space section, and this funnel section is formed from a single member only in the main body section by providing mating surfaces of the main body section and the duct component member off the funnel section.

3 Claims, 3 Drawing Sheets

INTAKE MANIFOLD

BACKGROUND OF THE INVENTION

1. Field of the Invention

The present invention relates to an intake manifold for air intake which feeds engine air.

2. Description of the Related Art

There has hitherto been known an intake manifold which is provided in order to feed air to each cylinder of an engine and fabricated from multiple component members, which are formed by techniques such as welding.

Such an intake manifold is provided with multiple ducts each of which communicates with each of the cylinders. And when the intake manifold is formed form multiple divided component members, it is general practice to provide mating surfaces of the component members along the axial direction of the ducts.

A representative example of this construction is described in the Japanese Patent Laid-Open No. 7-148769, for example.

In an intake manifold described in the Japanese Patent Laid-Open No. 7-148769, ducts and space portions provided on the inlet side of the ducts are divided at mating surfaces provided along the axial direction of the ducts, and these are joined together at these mating surfaces to form an internal molded resin part. This intake manifold is constructed in such a manner that the inlets of the ducts themselves are divided at the mating surfaces.

In a case where a funnel portion is provided at the inlets of the ducts in order to make the flow of the air smooth, as in the intake manifold described in the Japanese Patent Laid-Open No. 7-148769, if the mating surfaces are provided in such a manner that the inlets of the ducts themselves are divided, the funnel portion itself is also divided.

However, it became apparent that when the intake manifold is constructed by positioning the mating surfaces in the funnel portion, even when the component members are brought into close contact with each other on the mating surfaces, the air flow becomes turbulent in these parts.

Therefore, the present invention provides an intake manifold which can smoothly introduce air into ducts without making the air flow turbulent when a funnel portion is provided at the inlets of the ducts.

SUMMARY OF THE INVENTION

To solve the above-described problem, the present invention provides an intake manifold (1) which comprises a main body section (2) and a duct component member (30) which is fabricated by integrally molding multiple tubular bodies having a sectional shape in circular arc form which are arranged parallel. The duct component member (30) is welded to a surface of the main body section (2), whereby multiple ducts (31) for feeding air to each cylinder of an engine which are arranged parallel are formed. Inlets (18) of each of the ducts (31) are disposed by being arrayed on a same surface in a funnel section (50) which is formed in a communication space section (4) which communicates with the ducts (31) to feed introduced air thereto. A surface of the funnel section (50) is formed, at each of the inlets (18) of the duct (31), by a smooth curved surface which is widened toward the communication space section (4) and this curved surface is continuously connected to an inner circumferential surface of each of the ducts (31). In this intake manifold, by providing mating surfaces of the main body section (2) and the duct component member (30) off the funnel section (50), this funnel section (50) is formed from a single member only in the main body section (2).

In the present invention, for this intake manifold (1), the funnel section (50) is formed in such a manner that an inner side portion thereof which is opposed to an outer shell side of the communication space section (4) protrudes inward from an inner wall surface of the communication space section (4) and bulges outwardly of the inlets (18) of the ducts (31).

Furthermore, in the present invention, for the intake manifold (1), the duct component member (30) is vibration welded to the main body section (2) and formed integrally therewith.

According to the present invention, because the funnel section is formed from a single member, it is possible to cause the air introduced into the intake manifold to flow smoothly from the communication space section which provides communication between the introduction port and the ducts into the ducts without making the air flow turbulent.

Also, undercuts do not occur on the inner side of the funnel section. For this reason, it is possible to perform mold stripping during molding very smoothly.

Furthermore, it is possible to substantially increase the degree of freedom in designing the inclination of the funnel section and the port length of the inlets.

DETAILED DESCRIPTION OF THE PREFERRED EMBODIMENTS

An embodiment of the present invention will be described below with reference to the accompanying drawings.

Figure 1:
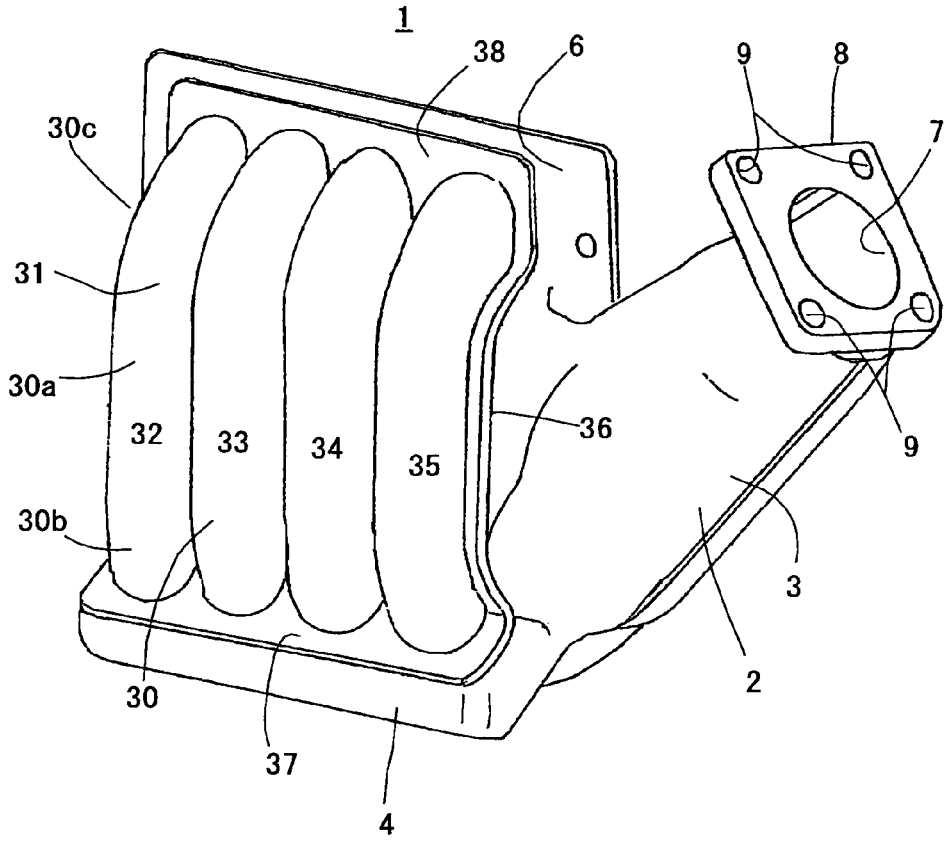
FIG. 1 is a perspective view of an intake manifold in an embodiment of the present invention.
Figure 2:
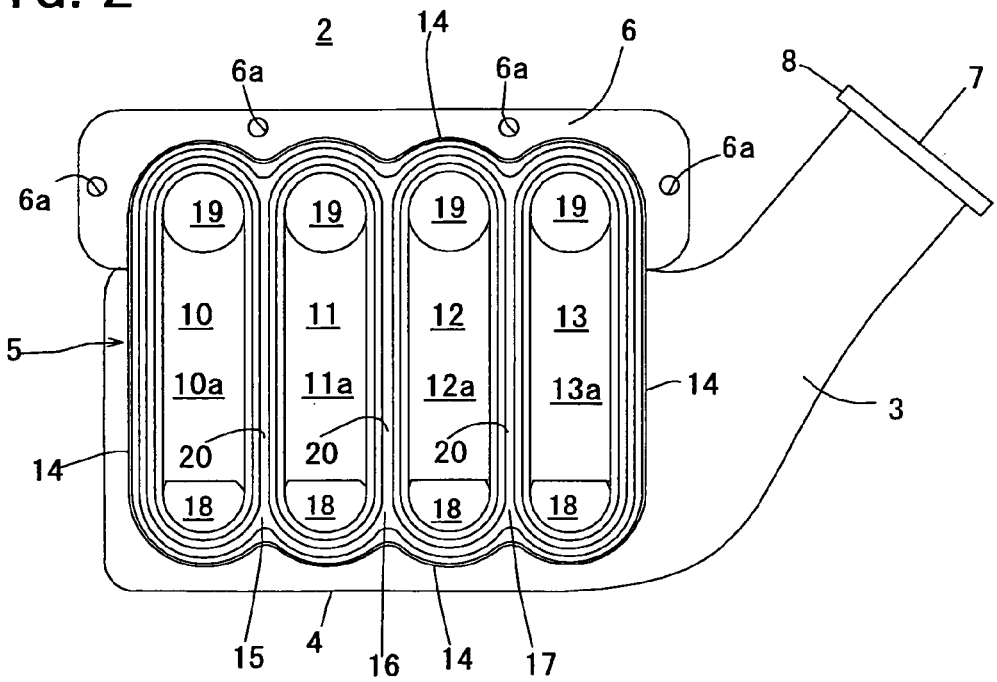
FIG. 2 is a plan view of a mating surface side of a main body section which constitutes the intake manifold.

FIG. 1 is a perspective view of an intake manifold 1 in an embodiment of the present invention. This intake manifold 1 is used to distribute the air introduced into one introduction port 7 and causes the air to be introduced into each cylinder of an engine. The intake manifold 1 is constituted by a main body section 2 and a duct component member 30.

The main body section 2 is provided with an introduction pipe 3 which introduces air, a communication space section 4 which distributes the introduced air and causes the air to flow into a duct 31, a duct formation section 5 which is formed as a duct 31 which causes the introduced air to circulate, and a head side flange 6 for connection to an engine head.

The introduction pipe 3 is provided in such a manner that a leading end thereof extends outward in a side part of the main body section 2. This leading end of the introduction pipe 3 provides the introduction port 7. At the leading end of the introduction pipe 3 which constitutes the introduction port 7, there is formed a rectangular connection flange 8 which bulges outwardly of the introduction pipe 3. This connection flange 8 is provided for connection to an upstream conduit which causes the air to circulate to the intake manifold 1, and holes 9 for tightening bolts are formed at four corners of the connection flange 8.

The communication space section 4 is formed along an end edge of the main body section 2, and the side of one end of the communication space section 4 communicates with the introduction pipe 3. Upon a surface wall surface of this communication space section 4 is formed part of a mating surface with which an end portion of the duct component member is to be mated, and in this part are formed four holes, which are arrayed in the direction in which the communication space section 4 extends. These holes provide parts which form the inlets 18 of the ducts 31.

The duct formation section 5 is a section which is formed as part of a peripheral wall of each of the ducts 31, and four passages 10 to 13 are formed parallel so as to connect the communication space section 4 and the head side flange 6 which provides the side of the other end of the communication space section 4.

A whole peripheral edge of the duct formation section 5 is enclosed with a partition 14, and a portion which forms the boundary of each of the passages 10 to 13 of the duct formation section 5 is partitioned by partitions 15 to 17. And in these partitions 15 to 17 are each formed grooves 20 at a center in the width direction thereof. Welded protrusions of the duct component member 30, which will be described later, are inserted into these grooves 20. On the other hand, portions 10*a* to 13*a* which provide inner circumferential surfaces of the duct 31 positioned between these partitions 15 to 17 are formed as substantially flat surfaces.

On the other hand, in the head side flange 6, in positions corresponding to end portions of the ducts 31, there are formed holes which pierce through the head side flange 6 are formed. These holes constitute outlets 19 of the ducts 31.

Next, a description will be given of the duct component member 30 which is welded to the duct formation section 5 of the main body section 2 to form the ducts 31.

The duct component member 30 is a member in which four tubular bodies 32 to 35 having a sectional shape in circular arc form are arranged parallel and these tubular bodies are integrally molded by being connected together by a base plate 36 in flat plate form. In FIG. 1, the bottom end portion of the duct component member 30 is a portion which is connected to the communication space section 4, and the top end portion is a portion which is connected to the head side flange 6. Also in this duct component member 30, each of the tubular bodies 32 to 35 is formed in such a manner that its shape as viewed in a plane extends substantially linearly to correspond to the duct formation section 5 of the main body section 2.

The construction of this duct component member 30 is such that in the thickness direction thereof, a middle portion 30*a* in the axial direction of the tubular bodies is formed flat without a curve, whereas both ends 30*b*, 30*c* in the axial direction are curved toward the main body section 2 side.

And at the end portion which is connected to the communication space section 4, a flange 37 which encloses circumferences of the four tubular bodies 32 to 35 is formed. The flange 37 is an end portion of the above-described base plate 36. This flange portion 37 is bent toward the outer side of the intake manifold 1 and formed to be inclined at an angle with respect to the middle portion of the base plate 36.

Also on an end portion (the upper side of FIG. 1) which is connected to the head side flange 6, a flange 38 which encloses circumferences of the four tubular bodies 32 to 35 is formed. Also this flange 38 is an end portion of the base plate 36. This flange 38 is bent toward the outer side of the intake manifold 1 and formed to be inclined at an angle with respect to the middle portion of the base plate 36.

In this embodiment, though not illustrated, it is preferred that in order to prevent a positional deviation between the main body section 2 and the duct component member 30 during vibration welding, claws or ribs with which a jig holding these members during vibration welding be formed in the base plate 36.

Figure 3:
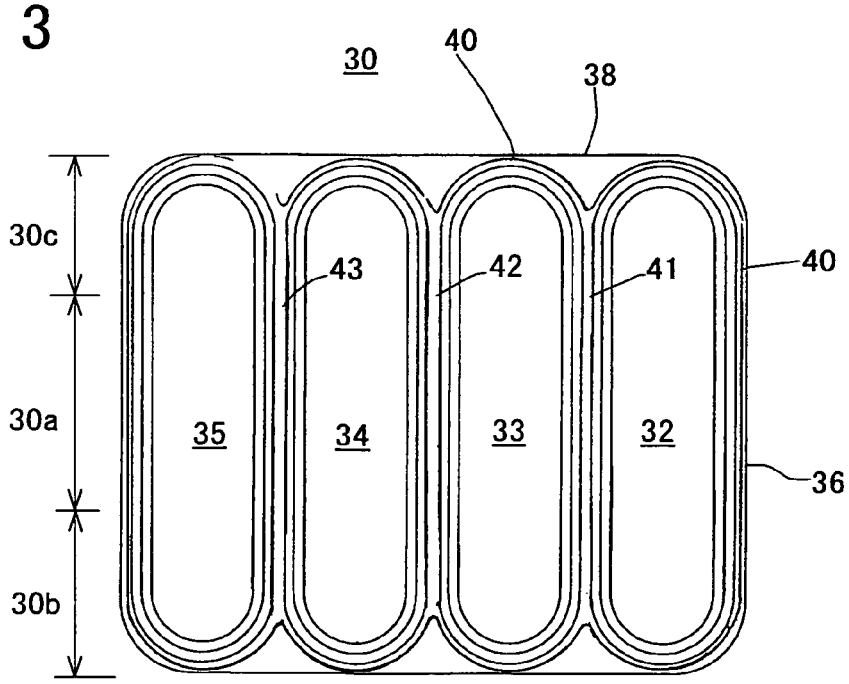
FIG. 3 is plan view on the mating surface side of a duct component member.

On the other hand, on a back surface of the duct component member 30, as shown in FIG. 3, there is provided a welded protrusion 40 which is formed so as to enclose the peripheral edge of the base plate 36. Furthermore, also in boundary portions of the tubular bodies 32 to 35, welded protrusions 41 to 43 are formed along the side edges of these tubular bodies. These welded protrusions 40 to 43 are formed at a certain height from the bottom surface of the base plate 36.

These welded protrusions 40 to 43 are fitted into grooves 20 formed in the partitions 14 to 17 of the duct formation section 5 of the main body section 2. After the fitting of the welded protrusions 40 to 43 into the grooves 20, the welded protrusions 40 to 43 are welded by frictional heat by pressing the duct component member 30 against the main body section 2 under minute vibration, whereby the duct component member 30 is welded to the main body section 2.

Figure 4:
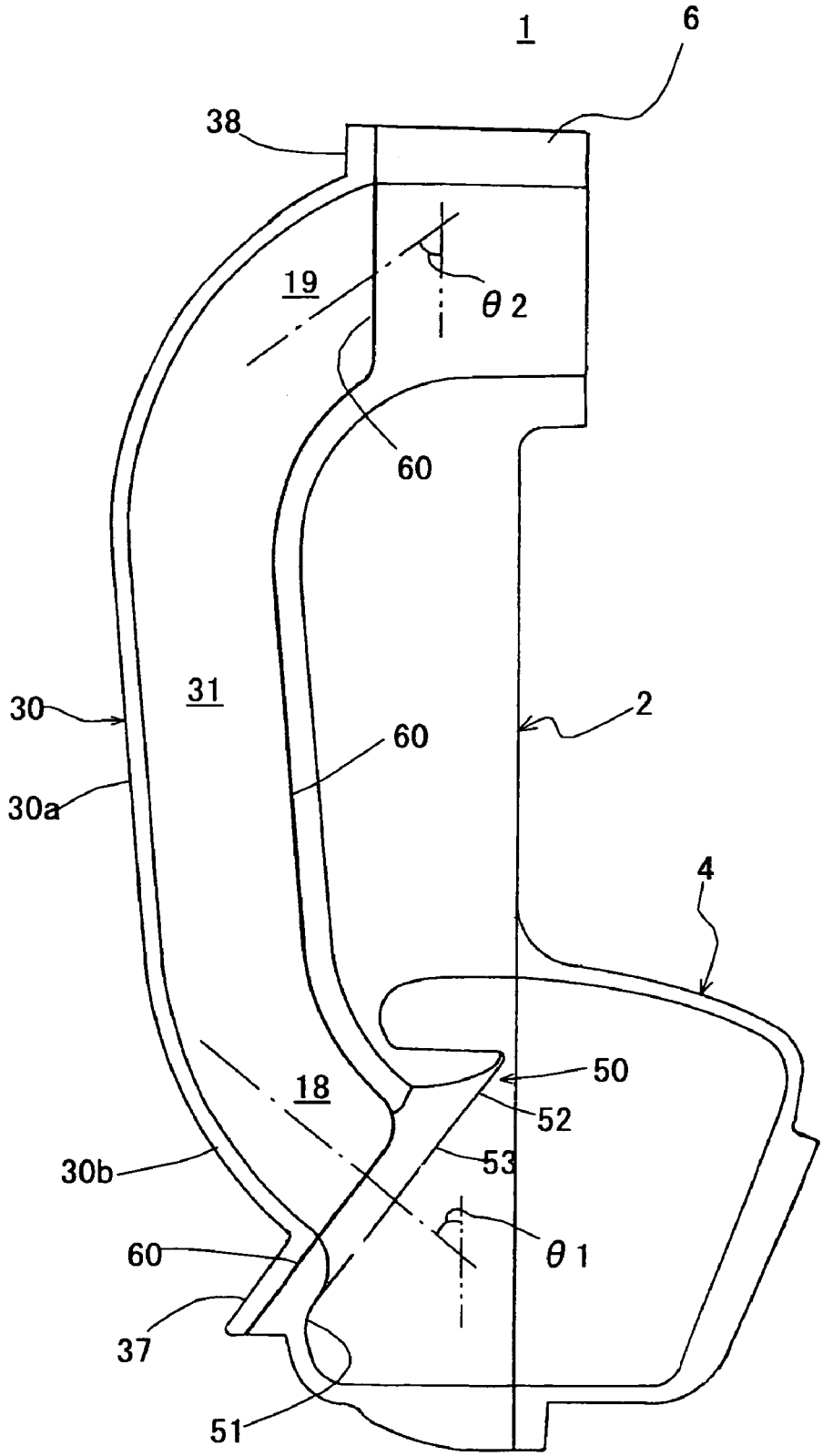
FIG. 4 is a sectional view which shows an internal structure of the intake manifold.

FIG. 4 shows the duct component member 30 thus constructed is welded to the main body section 2. As shown in FIG. 4, in the duct 31 which is formed by welding the duct component member 30 to the main body section 2, a passage is formed so as to substantially reverse the direction of the flow of air.

That is, on the inlet 14 side, the axial direction in which the duct 31 extends is formed so that an inclination angle $\theta 1$ with respect to the horizontal line becomes not more than 90 degrees, and on the outlet side 41, the axial direction in which the duct 31 extends is inclined so that an inclination angle $\theta 2$ with respect to the horizontal line becomes not more than 90 degrees. For this reason, the direction of the air which flows through the duct 31 is changed about 180 degrees according to the inclination of the duct 31.

The funnel section 50 having the function of arraying the inlets 18 of the ducts 31 on a same surface is formed in a part of the main body section 2 on the inlet 18 side of the duct 31. As is apparent from FIG. 4, the funnel section 50 formed in the main body section 2 is fabricated from a single member and has no joint. For this reason, the air which is introduced into the communication space section 4 through the introduction pipe 3 from the introduction port 7 flows smoothly into the duct 31 without becoming turbulent.

At the inlet 18 of each of the ducts, this funnel section 50 is formed so as to be widened outward as the funnel section 50 extends from the duct 31 toward the communication space section 4. And the surface of the funnel section 50 is formed from a smooth curved surface and continuously connected to an inner circumferential surface of each of the ducts 31. Also as is apparent from FIG. 4, the funnel section 50 is formed in such a manner that a portion 51 of the funnel section 50 on the outer shell side is formed as an integral curved surface with an inner circumferential surface of the communication space section 4 without a seam. On the other hand, a portion 52 on the inner side is formed so as to protrude from the inner circumferential surface of the communication space section 4 and bulge outwardly of the inlet of the duct 31. And a terminal end 53 of the funnel section 50 is formed substantially parallel to a mating surface 60 with the duct component member 30.

Incidentally, because there is no undercut on the inner side, i.e., the duct 31 side of this funnel section 50, catches and the like do not occur during the molding of the duct component member 30 and mold stripping can be very smoothly performed.

In addition, because the funnel section 50 is fabricated from a single member, it is possible to greatly increase the degree of freedom in designing the inclination of the funnel section 50 and the port length of the inlet 18.

What is claimed is:

1. An intake manifold, comprising:

a main body section and a duct component member which is fabricated by integrally molding multiple tubular bodies having a sectional shape in circular arc form which are arranged parallel;

the duct component member being welded to a surface of the main body section, whereby multiple ducts for feeding air to each cylinder of an engine which are arranged parallel are formed;

inlets of each of the ducts being disposed by being arrayed on a same surface in a funnel section which is formed in a communication space section which communicates with the ducts to feed introduced air thereto;

a surface of the funnel section being formed, at each of the inlets of the duct, by a smooth curved surface which is widened toward the communication space section and this curved surface being continuously connected to an inner circumferential surface of each of the ducts, wherein by providing mating surfaces of the main body section and the duct component member off the funnel section, this funnel section is formed from a single member only in the main body section.

2. The intake manifold according to claim 1, wherein the funnel section is formed in such a manner that an inner side portion thereof which is opposed to an outer shell side of the communication space section protrudes inward from an inner wall surface of the communication space section and bulges outwardly of the inlets of the ducts.

3. The intake manifold according to claim 1, wherein the duct component member is vibration welded to the main body section and formed integrally therewith.

* * * * *